US006058989A

United States Patent [19]

LaGrange et al.

[11] Patent Number: 6,058,989

[45] Date of Patent: May 9, 2000

[54] SELF ALIGNING KNIFE CLAMPING ASSEMBLIES AND MACHINES INCORPORATING THE SAME

[75] Inventors: Daniel M. LaGrange, Edmonton, Canada; Sven-Olov Biller, Hudiksvall, Sweden

[73] Assignee: Iggesund Tools AB, Sweden

[21] Appl. No.: 09/158,821

[22] Filed: Sep. 23, 1998

[30] Foreign Application Priority Data

Sep. 11, 1998 [CA] Canada ..... 2247062

[51] Int. Cl.[7] ..... B27G 1/00

[52] U.S. Cl. ..... 144/218; 144/229; 144/230; 144/241; 407/47; 407/49; 407/113

[58] Field of Search ..... 144/162.1, 176, 144/218, 229, 230, 241; 407/47, 49, 112, 113; 83/698

[56] References Cited

U.S. PATENT DOCUMENTS 4,594,938 6/1986 Thomas et al. ..... 144/230

4,685,497 8/1987 Mierau et al. ..... 144/241

5,469,902 11/1995 Sharp et al. ..... 144/241

*Primary Examiner*—W. Donald Bray

*Attorney, Agent, or Firm*—Fitzpatrick, Cella, Harper & Scinto

[57] ABSTRACT

A self aligning knife clamping assembly and machine incorporating the same are disclosed. In one embodiment there is provided a knife clamping assembly having an upper clamping component, a lower clamping component and a fastening device, such as a bolt, therebetween, to permit the clamping components to be releasably clamped together onto a knife element having a knife edge. Positioned between the knife element and the clamping assembly is a biasing element, which urges the knife element to enter, or remain in, a preferred position prior to the knife element being immovably clamped into place. In the preferred embodiment the biasing element is in the form of an elastomeric strip.

29 Claims, 8 Drawing Sheets

SELF ALIGNING KNIFE CLAMPING ASSEMBLIES AND MACHINES INCORPORATING THE SAME

FIELD OF THE INVENTION

This invention relates to the general field of wood working machines of the type that are used to process wood to form lumber, or to form chips, shavings, or wafers for pulp, or waferboard production. Most particularly, this invention relates to a knife clamping assembly used in such machines to hold knives in a part which contacts, usually by spinning, against wood to be chipped, planed, or waferized.

BACKGROUND OF THE INVENTION

Wood is an important natural resource and forms the basis of many of today's modern products. However, once trees are harvested and cut into logs, they usually need to be further processed prior to their end use. For example, in the pulp or oriented strand board industries, one often needs to pass the log through a machine which turns the solid log into a plurality of chips or wafers respectively. Such machines are typically referred to as chippers, which may be in a disk form, or a drum form, and waferizers, which also take a number of forms. In the sawmill industry, logs or semi-manufactured lumber are commonly passed through machines which chip or plane away the outside portions of the solid log or semi-manufactured lumber to transform the wood into finished lumber and a plurality of wood chips. Such machines are typically referred to as planers, chipper canters, chipper edgers, and chipper slabbers each which can take a number of different forms.

One of the objects of such chipping machines is to produce chips of wood that are generally of an even size and to produce such chips with a low amount of excessively small, thin, thick or oversized fractions that may be detrimental to their particular end use. For example, chips of an even size help facilitate further processing of the wood in the production of pulp. Having chips of an even size means that process controls can be established which result in a homogeneous treatment of the chips in the process. Since too many large sized chips or too many small sized chips can affect the quality of the output, wood chips are traditionally separated for size by screening with only the acceptable fraction being employed in the pulping process. The excessively small, thin, thick, or oversized fractions are removed and are often discarded or reprocessed. As a result, maximizing the amount of processed wood which is in the desired chip size while producing a minimum amount of reject material maximizes the efficient use of the wood. It is a similar goal of waferizing apparatus to produce wafers or strands of uniform size as well.

In lumber production, one of the objects of chipper canters, chipper edgers, chipper slabbers and planers is to produce lumber with a uniform and accurate cut surface. For example, an accurate cut surface allows for the production of lumber closer to targeted dimensions and of more uniform size. Having a more accurate control over lumber dimensions means that a more preferable cut location can be adopted allowing for a more efficient use of the wood.

Chippers and waferizers are typically large machines that include rotating disks or rotating drums equipped with a plurality of knives. More recently, chippers have included indexable knives such as shown in our earlier patents, Canadian Patent 1,201,695, and U.S. Pat. Nos. 4,047,670, and 5,348,065. Similarly, chipper canters, chipper edgers, chipper slabbers, and planers are machines that include rotating chipping heads or rotating planing heads of general cylindrical or conical profile equipped with a plurality of knives.

In many of the aforementioned machines, indexable or rotatable knives are preferred, because essentially, two or more knife edges can be provided on a small high quality knife element permitting increased operating efficiency and ease of use. However it will be appreciated, by those skilled in the art, that larger old style non-indexable type knife elements are also commonly in use.

In indexable knife arrangements, the knife element is commonly provided with a profile which is gripped between an upper and lower clamping surface. The upper and lower clamping surfaces hold the knife element in place while the knife element is directed onto the wood being processed. As such, the clamping assembly typically includes an upper clamping component, a lower clamping component and a bolt or a plurality of bolts to clamp the clamping components together. There may also be an associated adapter or adapters to hold the clamping assembly described above in place on a rotating disk, drum, or hub.

While such devices are very efficient in holding knives in place, by allowing the knife elements to be released and either rotated or replaced in the clamping assemblies, there are certain problems that are associated with them. One of the problems is to ensure that the knife edge is accurately positioned within the knife clamping assembly. What is desired in all cases, in order to produce chips of an even size, wafers of uniform dimensions, or lumber of accurately cut surface, is that the knife edge of the knife element be positioned at exactly the right distance relative to the machine. For example, in waferizing apparatus accurate positioning of the knife edge means that the wafers can be more precisely formed of the same size. In this respect, it will be understood by those skilled in the art that for a consistent wafer thickness to be achieved a precise knife projection above the drum or disk surface is required, and that even a small displacement of a knife edge, relative to the drum or disk surface could result in a different sized wafer being formed. Therefore, it is desirable to have the knife edge positioned with the highest precision possible relative to the spinning knife drum or disk.

Even with recent advances with indexable knives, the knife elements usually still need to be frequently replaced or rotated. Recent improvements to the design of knives and clamping assemblies can permit such knife replacements to be done efficiently and relatively easily by one or two workers. However, it is not always possible to position the rotation of the disk, drum, or hub such that the knife element being replaced or rotated is in an ideal position to be worked on. In some cases the workers may be reaching overhead, or around cumbersome components to make the change. Thus, it can be difficult to precisely position the knife element in the clamping assembly under such awkward circumstances. Further, each of the clamping components and knife elements must be built to certain tolerances. The smaller or tighter the tolerances the higher the costs typically associated with their manufacture. By reason of such tolerances there can be a resulting range for the location and orientation of the knife element within the clamping assembly. Generally, the larger the clamping assembly and knife element, the larger will be the corresponding set of tolerances, and potentially, more varied the fit. In practice, the combination of manufacturing tolerances and an awkward working environment conspire together to adversely affect precise knife edge positioning.

SUMMARY OF THE INVENTION

The present invention is directed to an invention which provides a method and apparatus for precisely positioning the knife edge of a knife relative to the machine carrying the knife. Most preferably, the method and apparatus overcomes the problems associated with manufacturing tolerances or shapes, which might otherwise permit knife edges, whether side by side or otherwise to be slightly displaced from an ideal position.

In addition, the present invention is also directed to a device which requires a minimum of effort to use, so field installations can be reliable and effective. The present invention reduces the need for individual judgement, and hence knowledge and experience of field personnel to achieve the desired results. The present invention thus provides an easy to use and inexpensive solution for providing highly accurate planing, chipping, and waferizing machines.

In one aspect of the present invention there is provided a biasing element for use in a knife clamping assembly, the knife clamping assembly being used to hold knives in machines used for processing wood, said biasing element comprising:

a body positioned between a knife element and a clamping component or components of a knife clamping assembly wherein said body is elastically compressible to bias said knife element relative to said knife clamping assembly said body being sized and shaped to urge said knife element to enter, or remain in, a preferred position in said knife clamping assembly prior to said knife element being immovably clamped in said clamping assembly.

In another aspect of the present invention there is provided a device for holding knives in position in machines used for processing wood, the device comprising:

a knife clamping assembly which is adjustable between a knife clamping position and an open position; and a biasing element, said biasing element being sized and shaped to bias a knife, placed in said knife clamping assembly, to a preferred position, as said knife clamping assembly is adjusted from said open position to said clamping position.

According to another aspect of the invention there is provided a knife clamping assembly for a machine for processing wood, said knife clamping assembly comprising:

an upper clamping component;

a lower clamping component;

a biasing element;

a fastening means for releasably clamping said clamping components together onto a knife element, wherein each of said clamping components includes a clamping surface or clamping surfaces for immovably engaging said knife element therebetween, and at least one of said clamping components is shaped to compensate for the combined deformation of said knife clamping assembly under a predetermined clamping pressure and wherein said biasing element is sized and shaped to urge the knife element to assume a preferred position within the clamping assembly as the clamping assembly is adjusted from an open position to a fully clamped position.

BRIEF DESCRIPTION OF THE DRAWINGS

Reference will now be made, by way of example only, to preferred embodiments of the invention as illustrated in the following Figures.

DETAILED DESCRIPTION OF THE PREFERRED EMBODIMENTS

Figure 1:
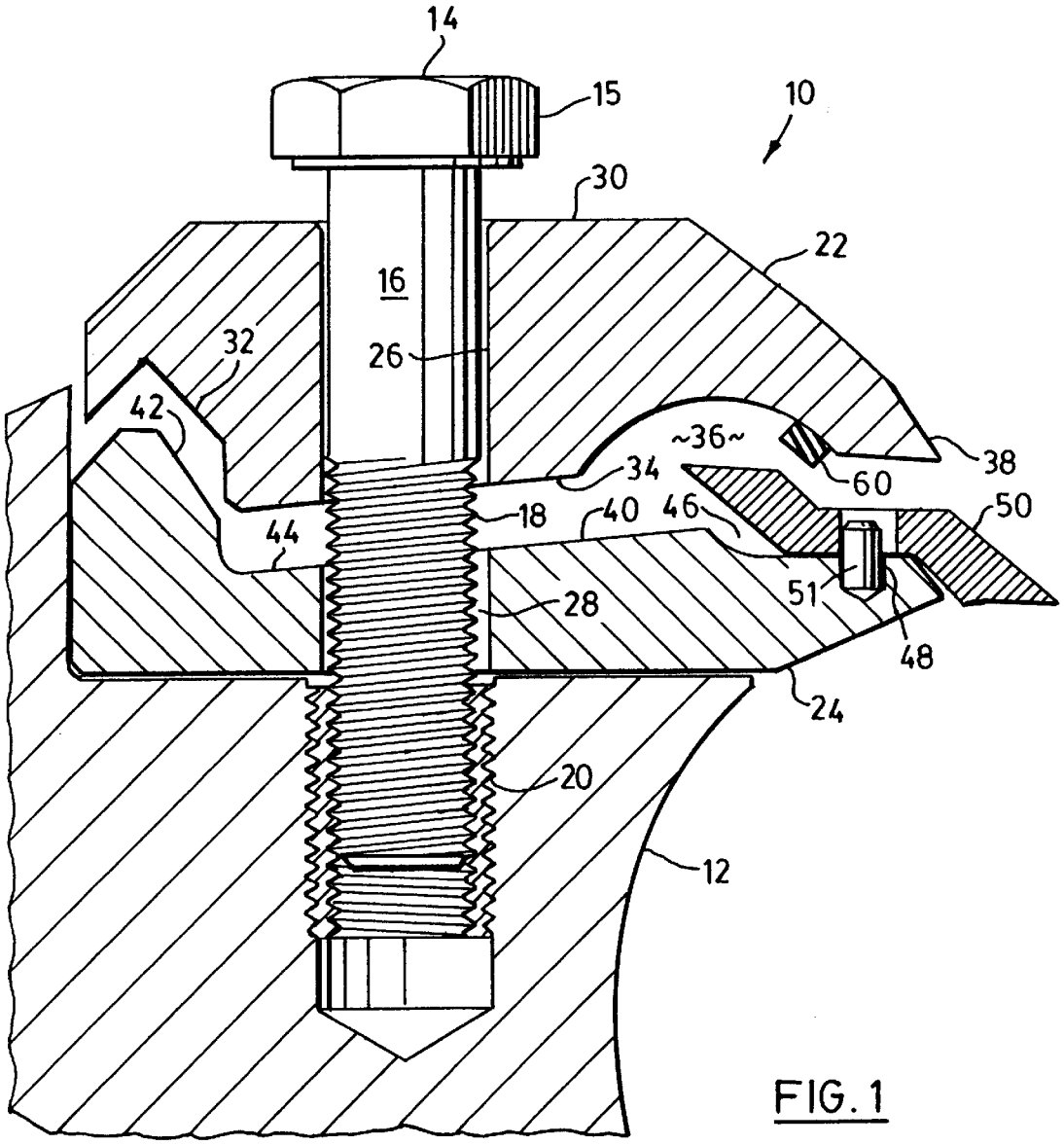
FIG. 1 is a side view of a segment of a chipping head used in a lumber producing machine having a clamping assembly according to the present invention.

FIG. 1 shows a knife clamping assembly, indicated generally at 10 according to the present invention. The knife clamping assembly 10 is mounted on a segment 12 as described herein. It will be appreciated, by those skilled in the art, that the segment 12 may be any form of disk, drum, or hub as may be used in waferizers, chippers, chipper canters, planers, or other rotating cutting machines of the type used to process wood to form lumber, chips, shavings, or wafers that includes knife clamping assemblies and knives.

The knife clamp assembly 10 of FIG. 1 includes a bolt 14 having a shaft 16 with a threaded portion 18. The bolt 14 is inserted into a threaded bore 20 formed in the segment 12. Although bolt 14 is shown, the clamping assembly may be formed with other types of fastening means, such as hydraulic or pneumatic mechanisms and the like.

The bolt 14 passes through an upper clamping component 22 and a lower clamping component 24. Together, the bolt 14, the upper clamping component 22, and the lower clamping component 24 form a knife clamping assembly. Tightening the bolt 14 by means of a head 15 causes the threads 18 to engage in the threaded bore 20 drawing the upper clamping component 22 down onto the lower clamping component 24. It will be appreciated by those skilled in the art that although a single bolt 14 is shown in one orientation, there may also be multiple bolts in the same or opposite orientation, in some machines, without departing from the scope of this invention.

The upper clamping component 22 is provided with a bore 26 to allow the bolt 14 to pass there through. Similarly, the lower clamping component 24 includes a bore 28 for the bolt 14.

Provided on the upper surface of upper clamping component 22 is a thrust surface 30. This thrust surface 30 permits the bolt head 15 to be tightened thereagainst. Although as shown in the drawings, the bolt head 15 rests proud of the upper surface 30, it will be appreciated by those skilled in the art that the bolt head 15 could also be recessed into the upper surface 30 of upper clamping component 22 if desired. The upper clamping component 22 includes a rear lower compound thrust surface 32, a lower inclined surface 34, and a cavity at 36. On the opposite side of cavity 36, is located press finger 38.

The lower clamping component 24 includes an upper surface 40 which has a rear compound hinge point 42, an inclined surface 44 and a recess 46. Also optionally included in the lower clamping component 24 is a bore 48 which houses a locating pin 51 (FIG. 2) as described in more detail below.

Also shown in FIG. 1 are an indexable or rotatable knife element 50, and a biasing element 60. It will be appreciated by those skilled in the art that many different geometries and configurations of clamping components and knife elements are available. The present invention is described in respect of one such configuration, but would be equally applicable to other configurations of clamping assemblies and knife elements.

Figure 2:
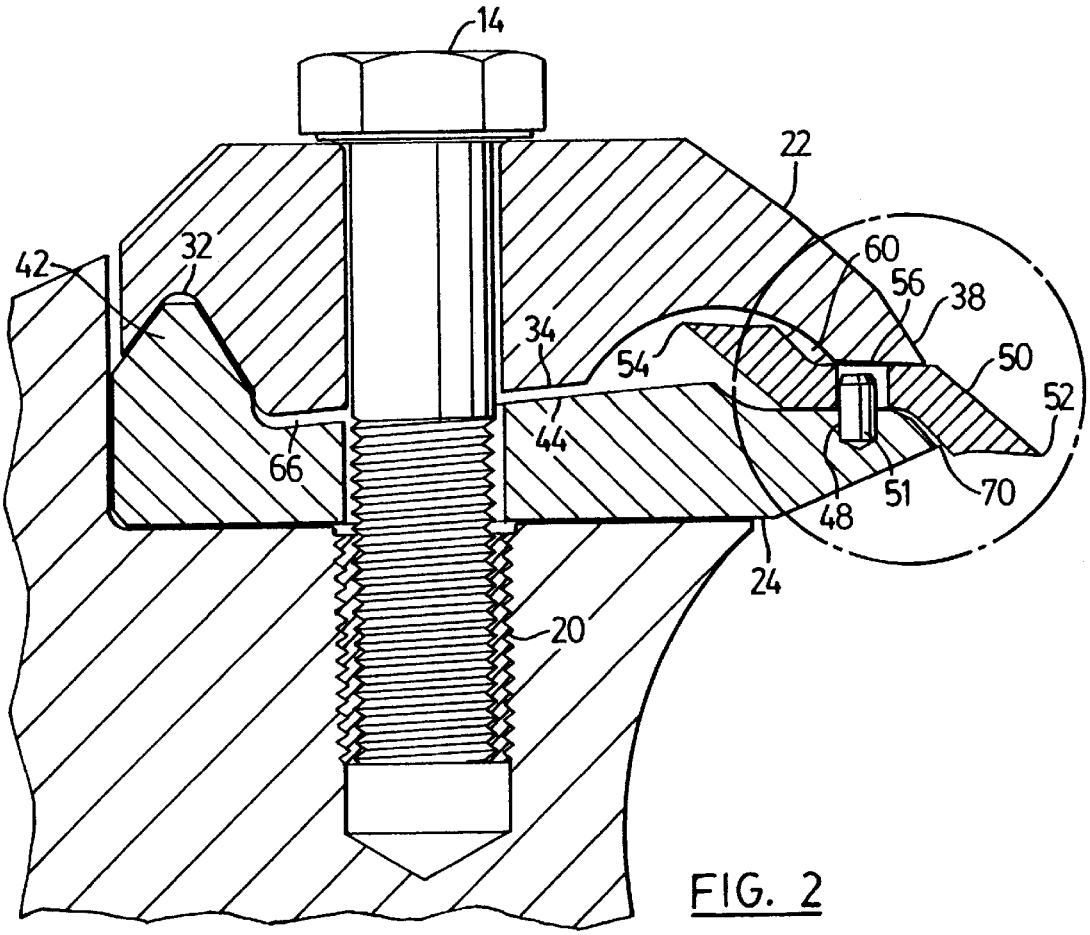
FIG. 2 is a close-up view of a clamping assembly of the machine of FIG. 1 just beginning to close.

Turning to FIG. 2, it can be seen that the bolt 14 has been advanced into the threaded bore 20 to a point where the finger 38 is making contact with knife element 50. It can now be appreciated that knife element 50 includes a first cutting edge 52 and a second cutting edge 54. These cutting edges may also be referred to as knife edges. One cutting edge (52) extends out from the segment 12, which is the cutting edge that is brought into contact with the wood to be processed, usually by spinning of the segment 12. The second cutting edge (54) is kept safe and out of the way within the cavity 36. Also shown in the knife element 50 is a locating slot 56 which straddles the locating pin 51.

Figure 3:
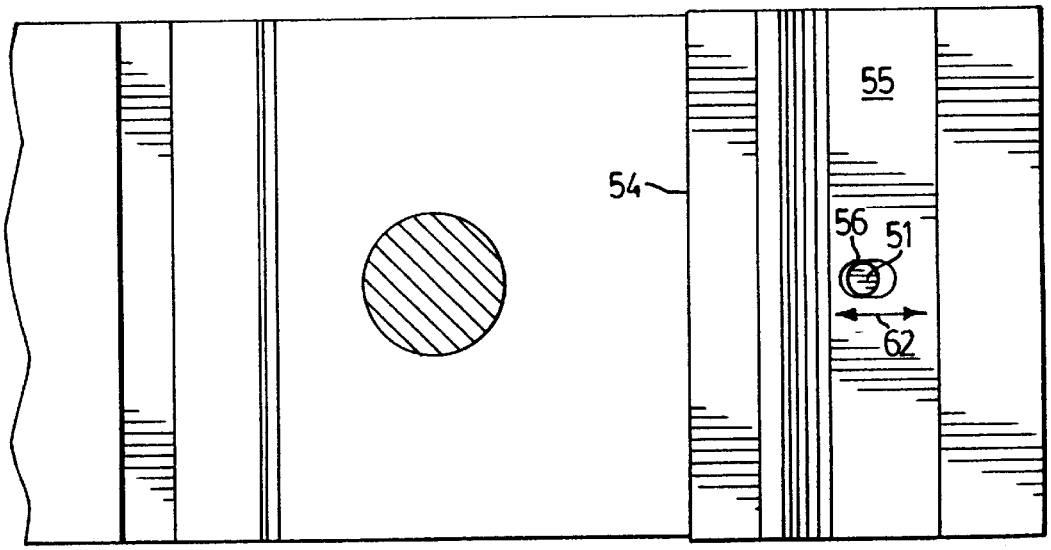
FIG. 3 is a plan view of the lower part of the clamping assembly of FIG. 2.

Referring to FIG. 3, which is a plan view, it can be seen that the locating pin 51 is closely straddled by slot 56 laterally, although there is still space for the knife element 50 to move axially (namely in the direction of arrows 62). In this manner, the side to side positioning of the element 50 can be restricted, although axial (in direction of arrow 62) movement will still remain.

It can now be appreciated how the upper clamping component 22 interacts with the lower clamping component 24. The rear hinge point 42 of the lower clamping component 24 contacts the compound thrust surface 32 of upper clamping component 22. At this point of contact, there is still a space 66 between the surfaces 34 and 44 on the upper and lower clamping components respectively. Therefore, additional tightening of the bolt 14 urges finger 38 to firmly grip knife element 50.

It can now be appreciated how the biasing element 60 of the present invention operates. As can be seen, in comparing FIG. 1 and FIG. 2, at the point that the thrust finger 38 contacts the knife element 50, the biasing element 60 is compressed. Thus, the biasing element 60 shown in FIG. 2 is substantially smaller than the biasing element 60 shown in FIG. 1 due to this initial compression. As the biasing element 60 is compressed more and more, a greater and greater force is exerted on the knife element 50. According to the present invention at least a portion of the force generated by compressing the biasing element 60 is in an axial direction (i.e. along the axis of arrow 62).

As can be seen in FIG. 2, although the knife element 50 is generally located laterally by locating pin 51, it is not precisely positioned axially with respect to the upper and lower clamping components because of the gap between the ends of slot 56 and locating pin 51. Thus, the knife element 50 may be malpositioned slightly as indicated by gap 70 between the knife element 50 and the lower clamping component 24.

Figure 4:
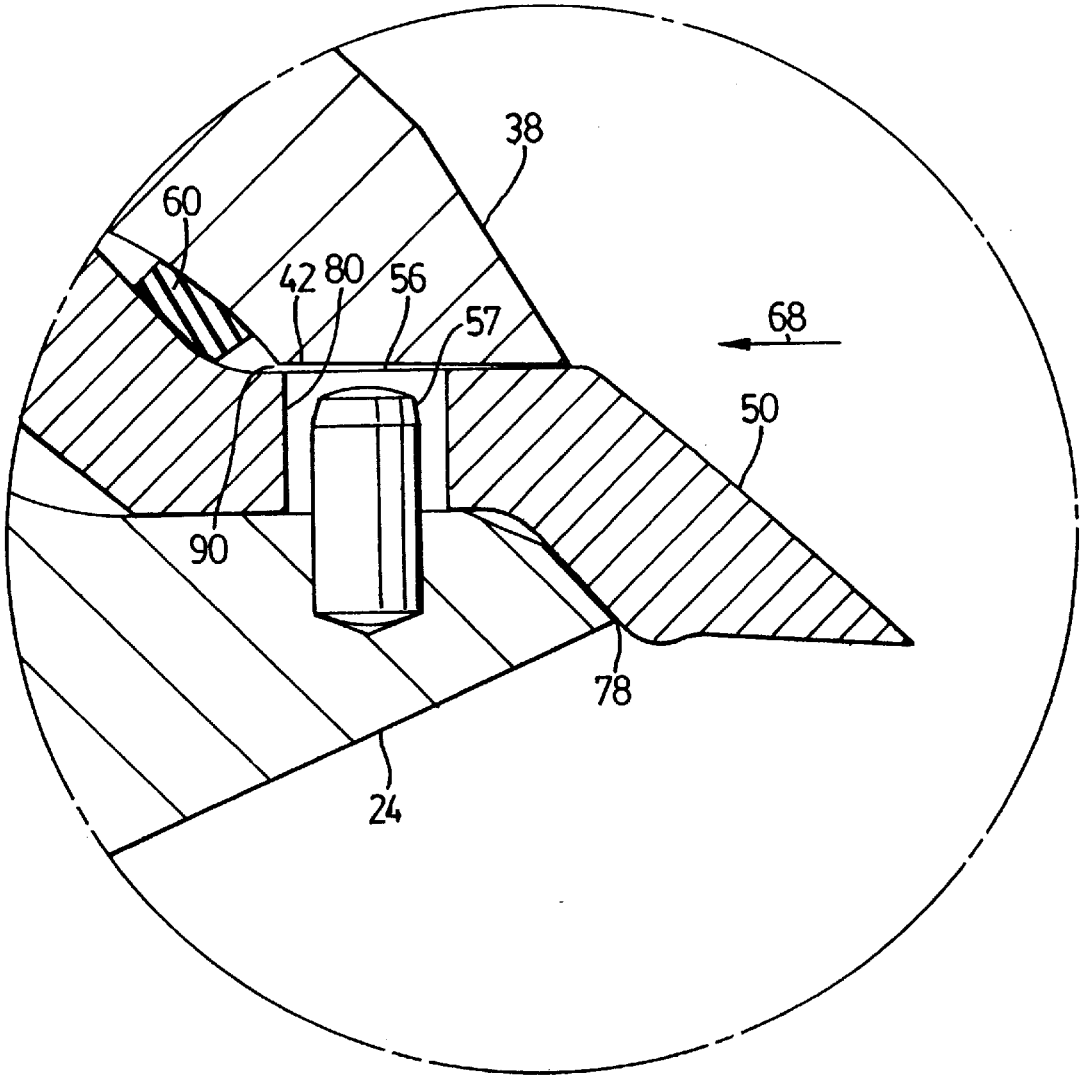
FIG. 4 is a close up view of the clamping assembly of FIG. 1 according to the present invention in a partially clamped position.

As the upper clamping component 22 is lowered onto the knife element 50, the first contact will most preferably occur between the biasing element 60 and the knife element 50. As the knife biasing element 60 is compressed, the biasing element 60 will urge knife element 50 to close or eliminate the gap 70. Therefore, the biasing element 60 acts to position the knife element 50 prior to frictional clamping engagement of the finger 38 on the knife element 50 which occurs with further tightening of bolt 14:

This can be more fully understood by referring to FIG. 4. In FIG. 4, it can be seen that the knife element 50 has been moved slightly in the direction of arrow 68, by reason of the biasing or urging of biasing element 60. Thus, where previously there was a gap 70, there now exists full contact between the knife element 50 and the lower clamping component 24 along surface 78. In addition, the locating pin 51 is no longer in contact with a left hand edge 80, of the slot 56, but rather is somewhat more centrally located in the slot 56. Thus, the biasing element 60 has adjusted the position of the knife 50 relative to the upper and lower clamping components before the knife element 50 is immoveable clamped between the upper and lower clamping components. It will be appreciated by those skilled in the art that the biasing element 60 needs to provide sufficient axial force to ensure the positioning of the knife element 50 relative to the clamping assembly prior to the clamping assembly clamping the knife element 50 in place.

It will be noted that there is provided an additional gap 90 between the thrust finger 38 and the upper surface of the knife element 50. It is desired to hold the knife element 50 in place, by reason of equal clamping pressure or force along surface 92 of thrust finger 38 and the knife element 50. Thus, to provide a maximum holding force requires that lower surface 92 be in full contact with the knife element 50 and that there be no gap 90 when in a fully clamped position.

According to one aspect of the present invention, the finger 38 is sized and shaped so that the combined deformation occurring in the upper clamping component 22 and the lower clamping component 24 results in lower surface 90 laying flush against the knife element 50 when bolt 14 has been tightened to a predetermined amount. In other words, in its unsprung state, a slight cant is built into the thrust finger 38 to permit it to deform under pressure in a manner that provides for full contact between lower surface 92 and the knife element 50 when at design bolt tightness.

Under such an arrangement as the upper clamping component 22 is lowered onto the knife element 50, the first contact will most preferably occur between the biasing element 60 and the knife element 50. As the knife biasing element 60 is compressed, the biasing element 60 will urge knife element 50 to remain in contact with surface 78. Therefore, the biasing element 60 acts to ensure the position of knife element 50 prior and even during the frictional clamping engagement of the finger 38 on the knife element 50 which occurs with further tightening of bolt 14.

Figure 5:
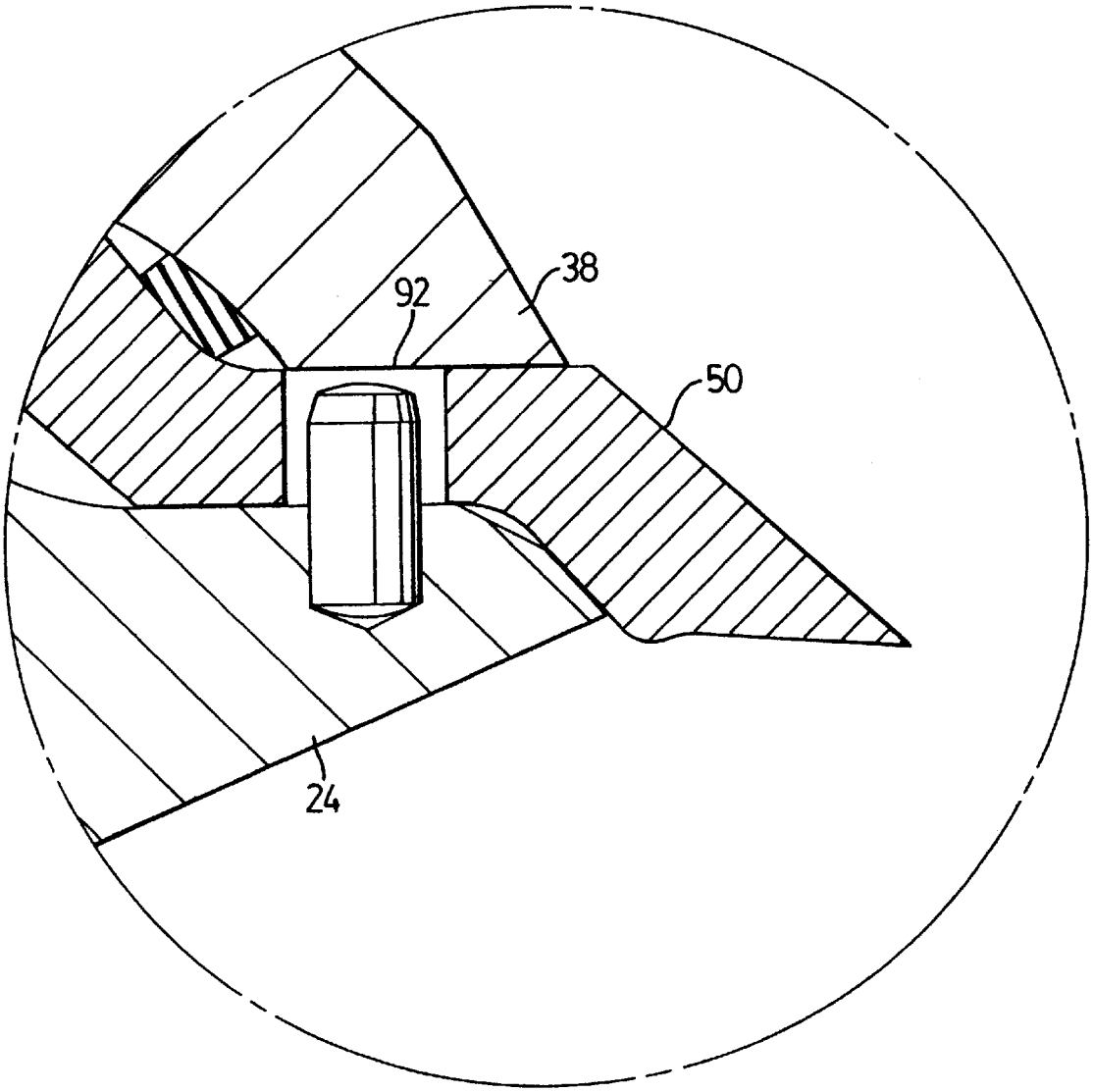
FIG. 5 is a close up view as in FIG. 4, with the clamping assembly in a fully clamped position.

Turning to FIG. 5, it can be seen that the gap 90 has disappeared and that the lower surface 92 is flush with the top of knife element 50.

The features and advantages of the present invention can now be more clearly understood. More particularly, rather than having the first contact between the clamping assembly and the knife be a rigid contact, a flexible or elastic biasing element 60 is provided which, upon contact with a knife element 50, begins to deform and as a result, urges the knife element 50 to enter or remain in close engagement with lower clamping component 24. In a sense, the clamping assembly includes a self positioning knife. This close or flush engagement with one of the clamping components of the clamping assembly assures an accurate positioning of the knife edge, and this position is considered the preferred position of the knife element 50 in the clamping assembly. Satisfactory results have been achieved through the use of an elastomeric composition, such as compounds of natural and butadiene-styrene rubber for biasing element 60. While the preferred form of the invention is to attach the biasing element 60, within the cavity 36, it also could be attached to the knife element 50 itself, or, to the lower clamping component 24. Adhesives have been found suitable to bond the biasing element 60 in place, but other methods of attachment may also be used.

In some cases, it may be necessary to ensure that any worn or damaged biasing elements 60 do not corrupt further wood processing. In such instances, it may be desirable to control the properties of the elastomeric material via a filler material, to ensure that the specific gravity of the biasing element 60 is greater than that of wood, so that if it does become loose and discarded, it may thus be easily separated from further wood processing through such devices as air density separators or other like apparatus. Filler materials such as metal filings have provided reasonable results.

It will be appreciated by those skilled in the art that the biasing element 60 may take any number of forms. Reasonable results have been obtained with rubber compositions, but the biasing element may also take the form of steel springs, leaf springs, or other resilient deformable components. What is desired, according to the present invention, is to generate a sufficient displacement force on the knife element 50 sufficiently along its length, to cause the knife element 50 to move into, or remain in, close engagement against the clamping assembly in a preferred position, prior to the frictional engagement of the clamping assembly on the knife element 50, or as set out in the example of the preferred embodiment when the finger 38 of the upper clamping component 22 clamps onto the knife element 50.

It can now be appreciated that when a biasing element is incorporated into a clamping assembly as taught by the present invention, it is possible to automatically urge the knife element into a preferred position (as close as possible to the desired position) within the clamping assembly. Therefore, even though each of the parts, namely, the knife element itself, the lower clamping component and the upper clamping component, may be formed within certain tolerances and shapes which would not normally assure or in some cases even permit a preferred location within the clamping assembly, use of the present invention will tend to automatically position the outer knife edge of the knife element 50 more accurately than would otherwise be possible, and without the need for excessive worker skill or care in knife edge placement.

Figure 6:
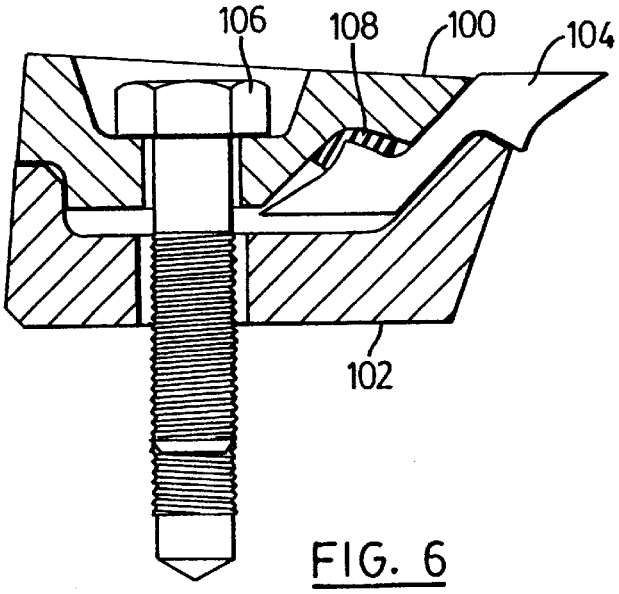
FIG. 6 is a close-up view of a different clamping assembly, of the type used in disc chippers, including a different form of biasing element.

FIG. 6 shows a further embodiment of the present invention. In this FIG. 6, there is an upper clamping component 100 and a lower clamping component 102. A knife element 104 is also shown, clamped between the two components. A fastener 106 is also shown, which is threaded, and draws the two clamping components 100 and 102 together, onto the knife element 104 in a clamping assembly. A biasing element 108 is also provided, and in this embodiment the biasing element takes the form of a thin strip having a length greater than its thickness. The geometry of the biasing element 108 is different from that of biasing element 60 with the geometry of the biasing element 108 being determined by the nature of the clamping assembly. The element 108 is sized and shaped to engage an appropriate face of the knife element 104 to permit the knife 104 to be biased into a preferred position in the clamping assembly, before the upper and lower clamping components immovably clamp the knife element therebetween. It will be noted that this is common to all of the embodiments of the present invention.

Figure 7:
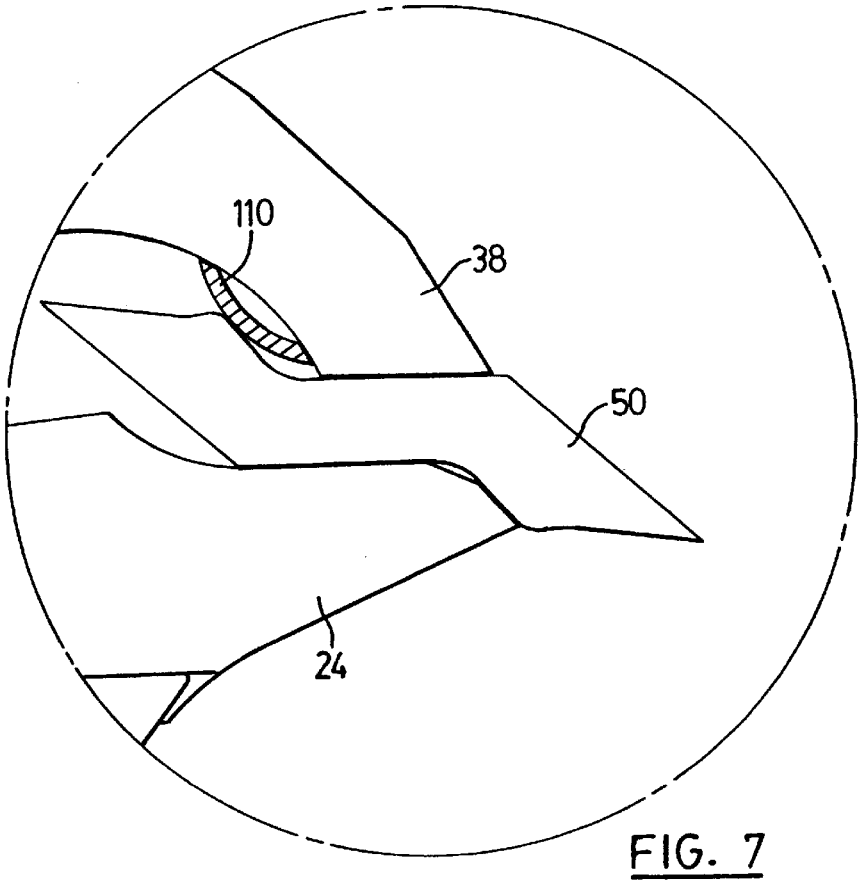
FIG. 7 is a close-up view of a further embodiment of the present invention.

FIG. 7 shows a further embodiment of the present invention, in a similar clamping assembly to that shown in FIG. 1 to 5 with like reference numbers referring to like elements. In this embodiment the biasing element, shown as 110, is in the form of a bent or curved member, which bows out from the upper clamping component towards a surface of the knife. The element 110 may be made from any suitably elastic material such as spring steel or the like, and relies on the geometry of the bend to provide a resilient force, in the nature of a spring, rather than the cushioning effect of the elastic bodies of the previous embodiments. However, the principles are the same as outlined above.

Figure 8:
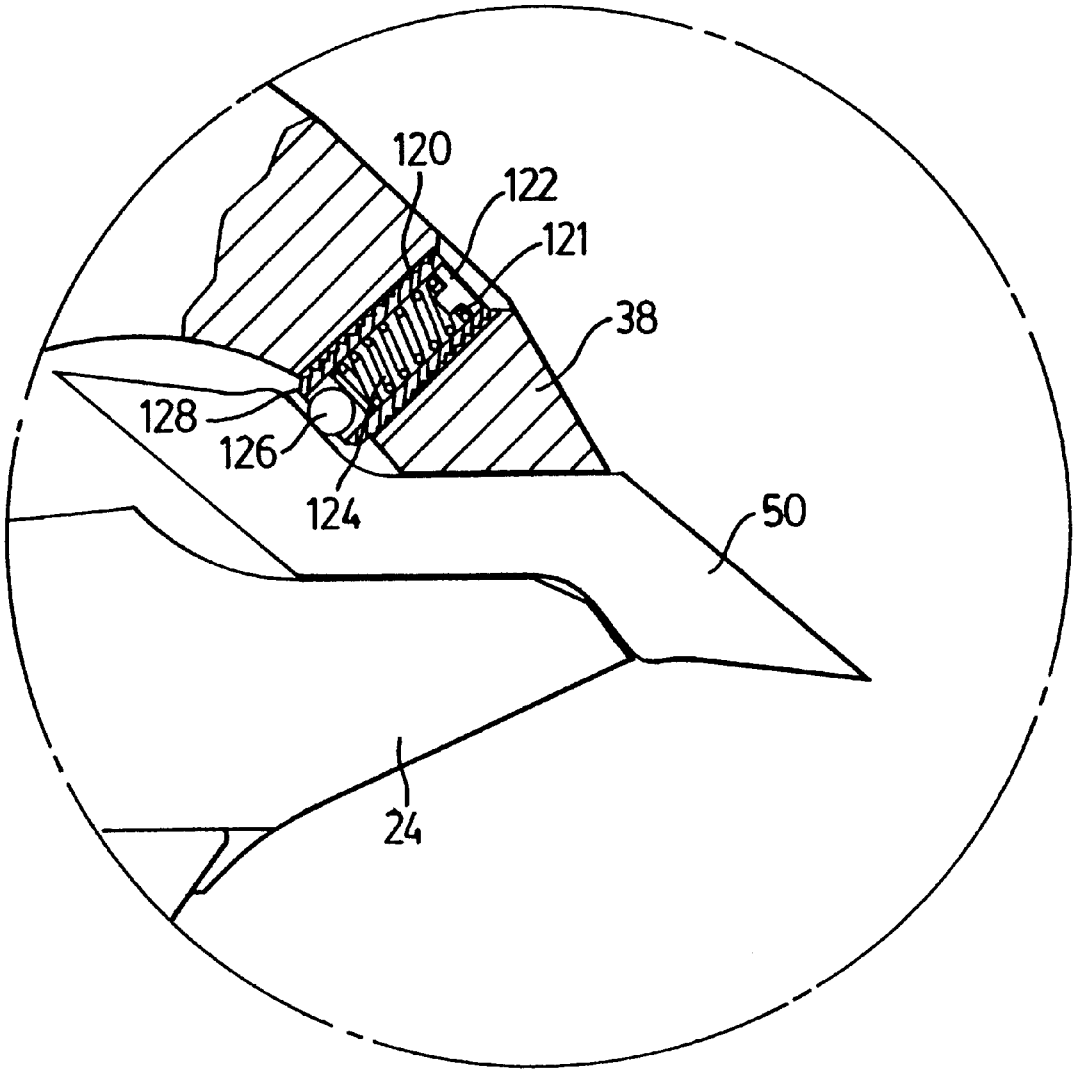
FIG. 8 is a close-up view of a further embodiment of the present invention.

FIG. 8 shows a further embodiment of the present invention which comprises a spring-loaded ball to urge the knife element in position. In this embodiment, a passageway 120 is provided in one of the clamping components (the upper one being shown). A biasing element 121 is located in the passageway and includes a hollow externally threaded member 122. Inside the member 122 is located a coil spring 124 and a steel ball 126. The hollow member 122 has a necked outlet 128, sized to permit the ball 126 to project out beyond the end of the hollow member 122. The coil spring 124 urges the steel ball 126 to an outward or extended position as shown. In this manner, the spring-loaded ball 126 makes contact with the knife element (as the clamping assembly closes on the knife element) causing the knife element to be located within the clamping assembly in a similar manner to the previous embodiments. A further advantage of this embodiment is that the position of hollow member 122 can be easily adjusted by means of external threads as shown. This permits a precise regulation of the seating or locating force of the biasing element.

Figure 9:
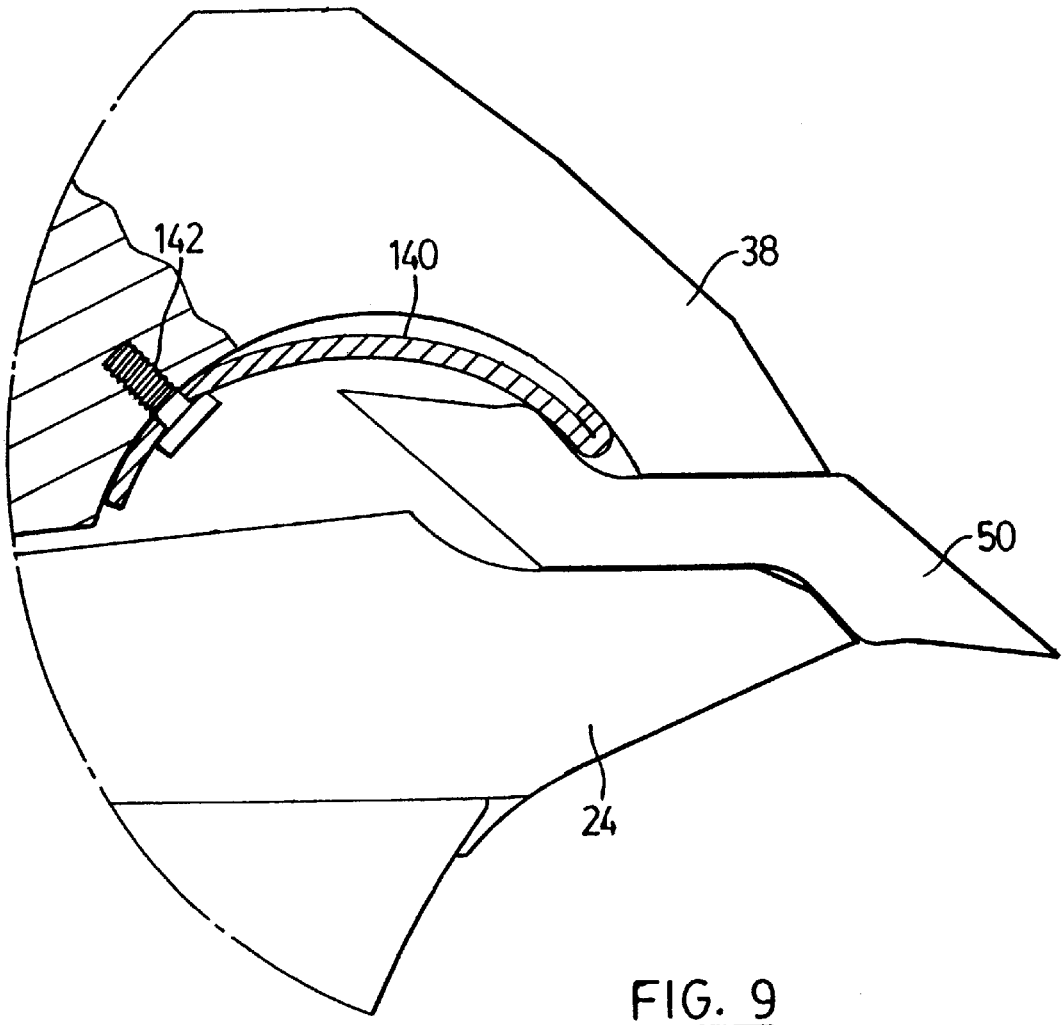
FIG. 9 is a close-up view of a further embodiment of the present invention.

FIG. 9 shows a further embodiment of the present invention, in the form of a leaf spring 140. In this embodiment the leaf spring 140 is attached towards a centre of the clamping component at fastener 142. This is preferred in heavy machinery, where it may be unacceptable to create a stress concentration within pressure finger 38 with the upper clamping component 22. Again, the spring can be made of any suitable material such as spring steel, or the like, and has the effect of urging the knife element in the position as shown.

It will now be appreciated that in each of the foregoing embodiments, the shape of the knife element and the shape of the clamping assembly are such that a void or space exists between the knife clamping assembly. In this way, space is provided for a biasing element to project into the void, which when closed, onto the biasing element urges the knife element into an aligned position.

Figure 10:
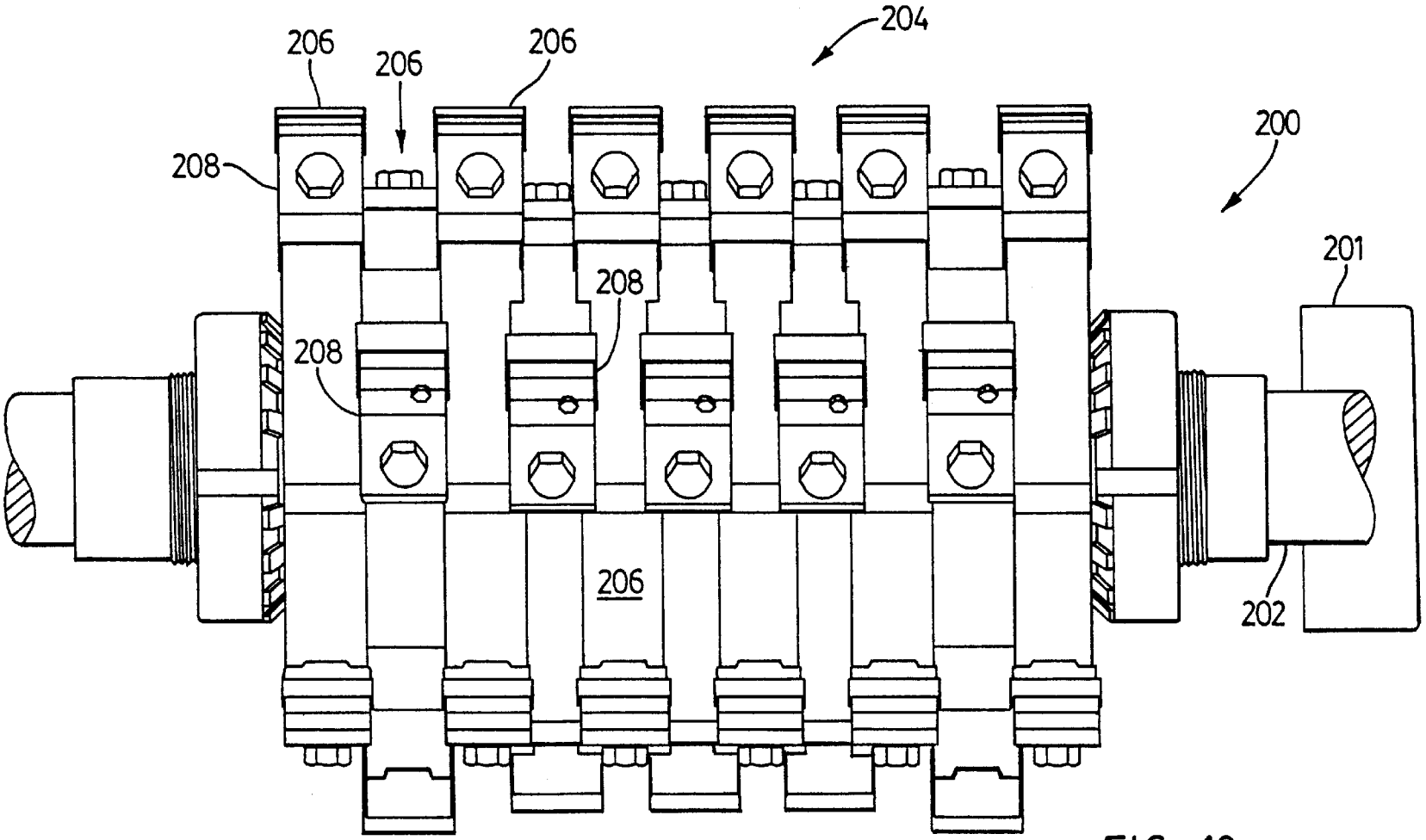
FIG. 10 is a view of a machine incorporating the present invention.

FIG. 10 shows a machine 200 having a motor 201, a drive shaft 202, and a main body 204. The main body 204 is comprised of individual spindle segments 206, each of which carry a plurality of knife clamping assemblies 208. As shown, each spindle segment 206 carries three assemblies 208. Within each knife clamping assembly 208, a biasing element according to the present invention is provided.

While the foregoing description has been made with reference to a preferred embodiment of the invention, various alterations and modifications are possible without departing from the broad scope of the appended claims. Some of these alterations and modifications are discussed above, and others will be apparent to those skilled in the art. For example, while reference is made to upper and lower clamping components, any device which can be selectively opened and closed onto a knife element is comprehended. Further, while the preferred form of the biasing element is a strip of elastomer, intermittent placing of biasing elements along the length of the knife element will also achieve similar results. As well, while an elastomeric biasing element has been discussed, any biasing element which is inserted between the clamping assembly and the knife, to urge the knife into a preferred position prior to the knife being clamped in the clamping assembly is also comprehended by this invention. Lastly, while reference has been made to indexable or reversable knives in the drawings, the present invention is also suitable for single edged knives, provided a shoulder or other surface is provided on the knife against which a biasing element may exert a seating or locating force.

The embodiments of the invention in which an exclusive property or privilege is claimed are as follows:

1. A biasing element for use in a knife clamping assembly, the knife clamping assembly being used to hold knives in machines used for processing wood, said biasing element comprising:

a body positionable between a knife element and a knife clamping assembly wherein, when said body is positioned between said knife element and said knife clamping assembly, said body is resiliently compressible to bias said knife element relative to said knife clamping assembly, said body being sized and shaped to urge said knife element toward an accurate cutting position prior to said knife element being immovably clamped in said knife clamping assembly.

2. A biasing element as claimed in claim 1 wherein said knife element and said knife clamping assembly are made according to set tolerances, and said biasing element biases said knife element toward an accurate cutting position in said knife clamping assembly within said set tolerances.

3. A biasing element as claimed in claim 1 wherein said biasing element is sized and shaped to bias said knife generally perpendicular to a knife cutting edge on said knife.

4. A biasing element as claimed in claim 1 wherein said body is comprised of an elastomeric material.

5. A biasing element as claimed in claim 4 wherein said body is a composite body comprised of an elastomeric material and a filler material.

6. A biasing element as claimed in claim 5 wherein said composite body has a specific gravity greater than wood.

7. A biasing element as claimed in claim 5 wherein said filler material is a metal.

8. A biasing element as claimed in claim 1 wherein said biasing element is in the form of a spring.

9. A biasing element as claimed in claim 1 in combination with a knife.

10. A biasing element as claimed in claim 1 in combination with a knife clamping assembly.

11. A device for holding knives in position in machines used for processing wood, the device comprising:

a knife clamping assembly which is adjustable between a knife clamping position and an open position; and a biasing element, said biasing element being sized and shaped to bias a knife, placed in said knife clamping assembly, toward an accurate cutting position, as said knife clamping assembly is adjusted from said open position to said clamping position.

12. A device as claimed in claim 11 further including a knife element, sized and shaped to create a void to at least partially accommodate said biasing element between said knife element and said knife clamping assembly, and wherein said knife element is sized and shaped to be clamped in said knife clamping assembly.

13. A device as claimed in claim 12 wherein said knife element is an indexable knife element having more than one cutting edge.

14. A device as claimed in claim 13 wherein said knife clamping assembly and said knife element are cooperatively shaped to permit said knife clamping assembly to clamp onto said knife element and to retain said knife element in place, without said knife clamping assembly clamping on a cutting edge of said knife element, whereby said knife element is thereby clamped in place.

15. A device as claimed in claim 14 wherein said knife element is made according to a first tolerance and said knife clamping assembly includes components made according to a second set of tolerances, and said biasing element biases said knife element toward an accurate cutting position in said knife clamping assembly within a range defined by said first and set of second tolerances.

16. A device as claimed in claim 11 wherein said knife clamping assembly includes a first clamping component and a second clamping component, the first and second clamping components being operatively connected to permit said components to clamp a knife element therebetween.

17. A device as claimed in claim 16 wherein said operative connection comprises a moveable fastening means, which can be selectively moved to loosen or tighten said knife clamping assembly onto said knife element as desired to loosen or tighten said knife clamping assembly onto said knife elements.

18. A device as claimed in claim 11 or 15 wherein said biasing element acts between said knife and said knife clamping assembly when said knife is placed in said knife clamping assembly.

19. A device as claimed in claim 11 or 15 wherein said biasing element is resiliently deformable, and has a tendency to return to an undeformed rest position subsequent to being deformed.

20. A device as claimed in claim 11 or 15 wherein said biasing element is comprised of an elastomeric material.

21. A device as claimed in claim 11 or 15 wherein said biasing element has a specific gravity greater than wood.

22. A device as claimed in claim 11 or 15 wherein said biasing element has a specific gravity of at least 2.0.

23. A device as claimed in claim 11 or 15 wherein said biasing element is comprised of an elastomeric material and includes a filler material to provide a predetermined specific gravity.

24. A machine for processing wood, said machine comprising:

a main body;

a plurality of knife clamping assemblies mounted to said main body;

a source of power to move said main body past a piece of wood to be processed;

a plurality of knives carried by said knife clamping assemblies; and a plurality of biasing elements, biasing said knives in said knife clamping assemblies toward an accurate cutting position.

25. A knife clamping assembly for a machine for processing wood, said knife clamping assembly comprising:

a first clamping component;

a second clamping component;

a biasing element as claimed in claim 1;

a fastening means for releasably clamping said clamping components together onto a knife element, wherein each of said clamping components includes a clamping surface or clamping surfaces for immovably engaging said knife element therebetween, and at least one of said clamping components is shaped to compensate for the combined deformation of said knife assembly under a predetermined clamping pressure and wherein said biasing element is sized and shaped to urge the knife element to assume a preferred position within the clamping assembly as the clamping assembly is adjusted from an open position to a fully clamped position.

26. A knife clamping assembly as claimed in claim 25 wherein said biasing element is comprised of an elastomeric material.

27. A knife clamping assembly as claimed in claim 26 wherein said biasing element is a composite body comprised of an elastomeric material and a filler material.

28. A knife clamping assembly as claimed in claim 27 wherein said composite body has a specific gravity greater than wood.

29. A knife clamping assembly as claimed in claim 25 wherein said biasing element is in the form of a spring.

* * * * *